United States Patent [19]

Dankman et al.

[11] 4,221,927

[45] Sep. 9, 1980

[54] VOICE RESPONSIVE "TALKING" TOY

[76] Inventors: Scott Dankman; Richard C. Levy; Bryan L. McCoy, all of 1001 Spring St., Ste. 724, Silver Spring, Md. 20910

[21] Appl. No.: 932,069

[22] Filed: Aug. 8, 1978

[51] Int. Cl.[2] ..... A63H 3/33

[52] U.S. Cl. ..... 179/1 VC; 46/232; 340/148

[58] Field of Search ..... 46/232, 254, 256, 170, 46/229; 179/1 VC, 1 AA, 1 AL, 1 SA; 340/148

[56] References Cited

U.S. PATENT DOCUMENTS

| | | | |
|---|---|---|---|
| 2,832,426 | 4/1958 | Seargeant | 46/244 |
| 2,974,441 | 3/1961 | Denner | 46/244 |
| 2,995,866 | 8/1961 | Johnson | 46/244 |
| 3,119,201 | 1/1964 | Brown et al. | 46/245 |
| 3,142,132 | 7/1964 | Johnson | 46/244 |
| 3,162,980 | 12/1964 | Hellman | 46/232 |
| 3,213,851 | 10/1965 | Currea | 179/1 AA X |
| 3,444,646 | 5/1969 | Domashovetz | 46/244 |
| 3,458,950 | 8/1969 | Tomaro | 46/243 |
| 3,469,039 | 9/1969 | Lee | 46/232 X |
| 3,567,863 | 3/1971 | Morrissey | 179/1 AA |
| 3,961,441 | 6/1976 | Sato | 46/256 |
| 4,103,105 | 7/1978 | Akiyama et al. | 179/1 VC |
| 4,107,462 | 8/1978 | Asija | 179/1 VC |

FOREIGN PATENT DOCUMENTS

| | | | |
|---|---|---|---|
| 45-15185 | 5/1970 | Japan | 46/232 |
| 965827 | 8/1964 | United Kingdom | 46/232 |

OTHER PUBLICATIONS

"It's Not R2-D2, But . . .", by H. Luxenberg, *The Washington Post*, May 28, 1978, p. L12.

*Primary Examiner*—Thomas W. Brown
*Attorney, Agent, or Firm*—Cushman, Darby & Cushman

[57] ABSTRACT

A toy which, in response to a complex sound such as human speech generates a train of audio pulses. The pulses are psuedo-random with respect to frequency composition and to duration, thus simulating syllabic speech. Provisions are also described whereby the length of the pulse train is made random.

19 Claims, 4 Drawing Figures

VOICE RESPONSIVE "TALKING" TOY

The present invention relates to voice responsive toys and in particular, to a toy which simulates responsive speech, albeit in a strange language.

In general, remote controlled toys are well known in the art. For example, toy vehicles which are controlled responsive to sound are described in the following U.S. Pat. Nos.: 2,832,426 issued Apr. 29, 1958 to W. A. Seargeant; 3,142,132 issued July 28, 1964 to T. M. Johnson; 3,961,441 issued June 8, 1976 to A. Sato; 3,444,646 issued May 20, 1969 to V. Komashovetz, and 2,995,866 issued Aug. 15, 1961 to T. M. Johnson. Such patents are responsive to sounds of a particular frequency or frequencies, and generally either do not respond to the sound of the human voice, or, do not discriminate between the human voice and other sounds.

Other toy vehicles, such as those described in U.S. Pat. Nos. 2,974,441 issued Mar. 14, 1961 to H. Denner, and 3,458,950 issued Aug. 5, 1969 to P. M. Tomaro are responsive to sounds of a relatively long duration only, to discriminate against background voices. Such discrimination is accomplished by including a delay in the electrical circuitry.

Another sound responsive toy, in the nature of a Jack-in-the-Box is described in U.S. Pat. No. 3,119,201 issued Jan. 28, 1964 to W. Brown et al. That toy is responsive to sounds within a particular range of frequencies.

Talking toys, in general, are also known in the art. For example, U.S. Pat. No. 3,162,980 issued Dec. 29, 1964 to W. F. Hellman describes a doll incorporating a tape recorder within the body which is selectively controlled by moving the limbs of the doll. Similarly, Mego International Inc. produces a talking robot, referred to as the 2-XL Robot, which utilizes an 8-track tape player within the body of the robot. The tape recorder's operation is responsive to a number of coded buttons disposed on the robot's chest.

The present invention provides a toy which will simulate responsive conversation with a child or adult, albeit in a strange and foreign language.

Figure 1:
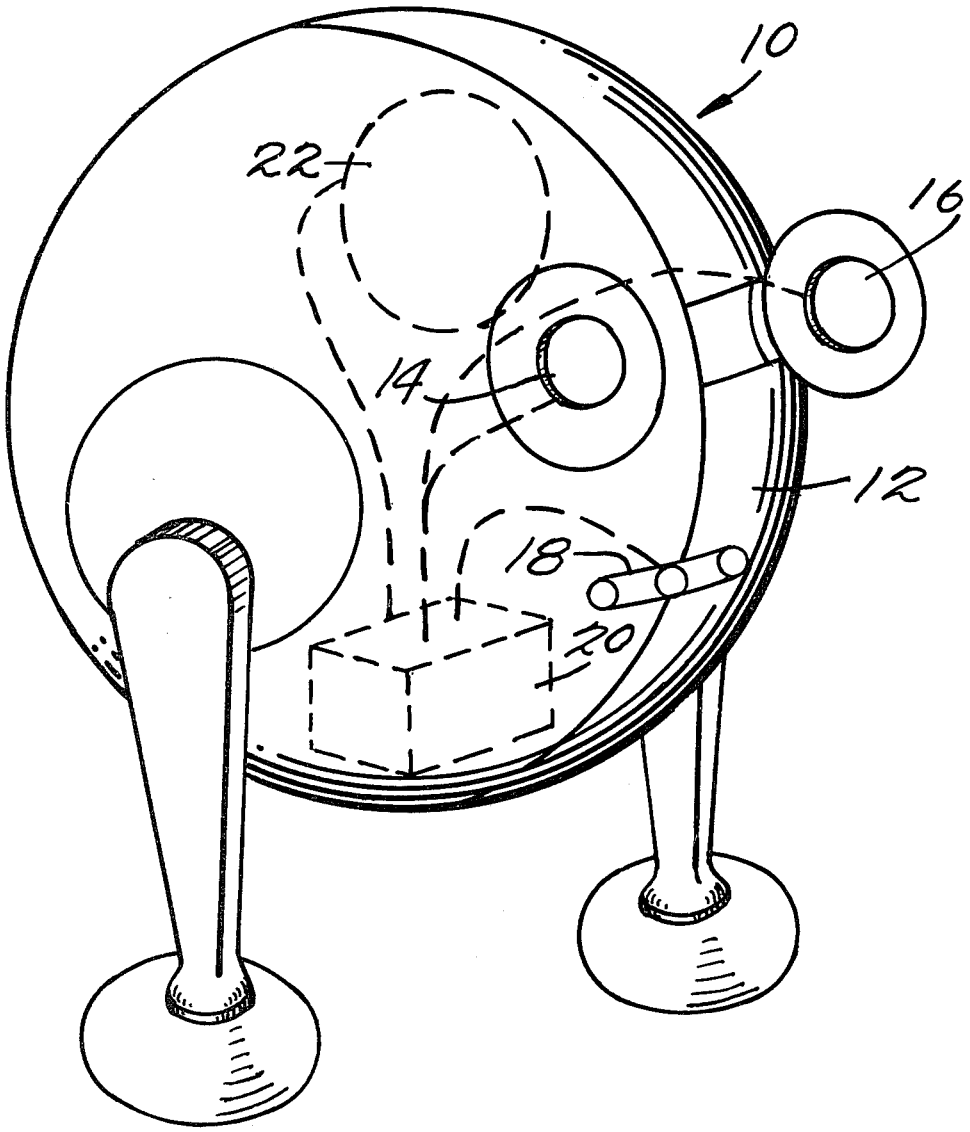

A preferred exemplary embodiment of the present invention will be described in conjunction with the appended drawings wherein like numerals denote like elements, and:

FIG. 1 is a pictorial illustration of a toy in accordance with the present invention; and FIG. *2a, 2b* and *2c* together comprise a schematic diagram of the circuitry utilized in the preferred embodiment.

Referring now to the drawings, there is shown in FIG. 1, a toy 10 in accordance with the present invention. A body 12, having portions 14 and 16 corresponding to eyes and a portion 18 corresponding to a mouth, has disposed therein an electronic circuit 20 and an audio/electrical transducer 22. Transducer 22 is disposed within the body 12 in such a manner that it is responsive to sound waves impinging upon the toy, and can emit an audio response. Transducer 22 may comprise a conventional high impedance speaker which operates both as a microphone and as a output device, or can be separate speaker and microphone devices.

Electronic circuitry 20 is shown in FIGS. *2a, 2b* and *2c*. Transducer 22 generates an electrical signal in response to and representative of audio sound waves impinging thereon. The transducer electrical output signals are applied to means for generating an actuation signal, generally indicated at 24. More specifically, in the preferred embodiment the transducer electrical output signals are applied to signal shaping circuitry including an operational amplifier (op amp) rectifier circuit 26 and an op amp integrator/clipper circuit 28 both suitably formed using a National Semiconductor LM1588 dual operational amplifier. Together, rectifier 26 and integrator/clipper 28 operate to produce an output signal which is essentially a squarewave with a repetition rate indicative of the audio signal.

The squarewave output signals from integrator/clipper 28 are inverted, and sampled at a predetermined sampling frequency (e.g., 24 Hz) by a conventional D-type flip-flop (FF) 30. As is well known in the art, the logic level present at the data (D) input of a D-type FF is assumed at the Q output thereof in response to a positive going transition in the clock signal applied to the clock (C) input terminal. A suitable D-type flip-flop is the National Semiconductor MM74C74 dual D flip-flop.

The Q output (sample) signal of flip-flop 30 is applied to a ripple counter 32, which is periodically reset at a predetermined frequency. Ripple counter 32 suitably comprises two D-type flip-flops interconnected in a conventional ripple counter configuration (with $\overline{Q}$ output tied to data input and each successive stage being clocked by the $\overline{Q}$ output of the preceeding stage). The first stage of the counter is clocked by the Q output of flip-flop 30. The D-type flip-flops of ripple counter 32 are reset in response to application of a low level signal at reset inputs R, suitably at a 0.75 Hz repetition rate.

Recalling that D-type flip-flops are clocked in response to positive going transitions at the clock input C, a high level output signal is produced at the output of ripple counter 32 only when the output signal of integrator clipper 28 is such that the sample signal (FF30) changes state a predetermined number of times within the period defined by the reset signal to ripple counter 32. It has been found that complex sounds such as human speech generates an integrator-clipper 28 output signal such that samples taken at a 24 Hz rate, change states at least on the order of twice during a one and one-half second interval. Accordingly, a two flip-flop ripple counter 32 is utilized with a 0.75Hz reset frequency. The Q output signal of the ripple counter 32 is therefore utilized as an actuation signal generated in response to complex sounds such as human speech.

The actuation signal from ripple counter 32 is applied to circuitry for generating an audio response, generally indicated as 34. More specifically, in the preferred embodiment, the actuation signal is applied to the set input (S) of a conventional RS flip-flop 36 suitably formed of two cross-coupled NOR gates. RS flip-flop 36, as well known in the art, generates a high level Q (and low level $\overline{Q}$) output signal when set in response to a high level signal at its set (S) input and is reset (Q low, $\overline{Q}$ high) in response to a high level signal at the reset (R) input thereof.

Coupled to the $\overline{Q}$ output terminal of flip-flop 36, through a suitable NOR gate 37 and inverting driver 38 are LED's 14 and 16 corresponding to the eye portions of body 12. Thus, when the actuation signal is applied to flip-flop 36, the $\overline{Q}$ output assumes a low level, enabling NOR gate 37. NOR gate 37 is also responsive to an electrical signal comprising pseudo-random combinations of respective electrical tones (frequencies), as will be explained. Accordingly, eye LED's 14 and 16 are intermittently activated almost immediately upon generation of the actuation signal, flashing in seeming acknowledgement of the toy being verbally addressed.

The Q output of flip-flop 36 is utilized to enable the speech response portion of circuit 34. More specifically, the Q output terminal of flip-flop 36 is coupled to the reset terminals R of two D-type flip-flops 40 and 42, which are interconnected in counter configuration to form, in effect, a delay circuit. The clock input terminal of flip-flop 40 (first stage of the counter) is responsive to a clock signal, suitably at 1.5 Hz frequency. The respective Q output terminals of flip-flops 40 and 42 are applied to two inputs of a three-input NAND gate 44. The third input of NAND gate 44 is receptive of the Q output of a third D-type flip-flop 46, also connected in counter configuration with $\overline{Q}$ output coupled to data input. The output of NAND gate 44 is coupled to one input of a two input NAND gate 48, the output of which is applied to the clock input C of flip-flop 46. The other input terminal of NAND gate 48 is receptive of an end of period signal, utilized to reset flip-flops 36 and 46, as will hereinafter be explained.

In operation, when the actuation signal sets flip-flop 36, the Q output thereof assumes a high level, enabling the delay ripple counter formed by flip-flops 40 and 42. Accordingly, after three counts of the 1.5 Hz clock signal applied to flip-flop 40, flip-flop 46 is clocked causing generation of a high level output signal. The Q output terminal of flip-flop 46 is connected, in addition to the input terminal of NAND gate 44 as noted above, to a NOR gate 50, and to a circuit for controlling a plurality of LED's disposed within the mouth portion 18 of body 12. The mouth LED circuitry is generally indicated as 52. NOR gate 50 is receptive of electrical tone pulses representative of syllables of speech from a speech generator circuit 54, and operates to gate the electrical pulses to transducer 22 (through a suitable amplifier 56) to effect generation of the audio output.

Speech pulse generator circuit 54 is free running, and generates a train of individual pulses, pseudo-random both as to frequency composition and duration. Circuit 54 comprises in the preferred embodiment, a conventional voltage controlled oscillator (VCO) 58 driven by an analog signal derived by a D/A converter 60 from a digital code word produced by a pseudo-random code generator 62. Pseudo-random code generator 62 comprises a shift register 64, suitably a National Semiconductor MM74C164 8-bit parallel output serial shift register and two exclusive OR gates 66 and 68. As is well known in the art, in response to positive going transitions applied to the clock input (C) of the register, the logic level instantaneously applied to the data input (D) is loaded into the first stage and data is serially shifted between the successive stages of the shift register. Separate output terminals associated with the respective stages of the shift register are provided. The contents of shift register 64 are made to vary in a pseudo-random fashion by connecting various of the output terminals back to the data input terminal through exclusive OR gate 66. In the preferred embodiment, the output terminals from the third and eighth stages are so connected. The output signals of exclusive OR gate 66 are applied to one input terminal of a second exclusive OR gate 68. The other input terminal of which is receptive of a signal of predetermined frequency, suitably 0.75 Hz. The output signals of exclusive OR gate 68 are applied to the D input of shift register 64. Exclusive OR gate 68 ensures that no stalling occurs in the operation of pseudo-random code generator 62.

D/A converter 60 is suitably a conventional ladder-type resistive network and generates an analog voltage in accordance with the contents of shift register 64. In the preferred embodiment, D/A converter 60 is connected only to the odd numbered output terminals of shift register 64 (Q1, Q3, Q5 and Q7) to provide additional randomness, as will be explained. The analog voltage is applied across a smoothing capacitor 70 and therefrom to VCO 58. VCO 58 therefore produces a signal having a frequency which changes in a pseudo-random manner in accordance with a 12Hz signal applied as a clock to shift register 64.

The VCO output signal is applied to the clock input of a binary counter 72, suitably a National Semiconductor MM74C163 binary counter with synchronous clear. Binary counter 72 provides a plurality of output signals, hereinafter referred to as electrical tone signals having respective frequencies related to the frequency of the VCO output signal. The frequencies of the electrical tone signals are suitably an octave apart. Binary counter 72 suitably provides three output signals respectively developed at the second, third and fourth stages thereof.

The electrical tone signals from binary counter 72 are applied as input signals to suitable combinatorial logic 74. Combinatorial logic 74 is also receptive of the VCO output signal and signals indicative of a pseudo-random code. Combinatorial logic 74 suitably comprises a first bank of two input NAND gates 75–78, the output terminals of which are connected to the input terminals of the multi-input NAND gate 80. NAND gates 75–78 are receptive of, at one input terminal, the VCO output signal and the electrical tones from binary counter 72, respectively. The other input terminals thereof are receptive of signals from the even numbered stages of shift register 64 (Q8, Q6, Q4, Q2). Thus, the output signal from combinatorial logic 74 consists of portions (of a duration corresponding to the 12 Hz clock signal to shift register 64) having a frequency composition in accordance with pseudo-random combinations of the VCO output signal and the electrical tone signals from binary counter 72.

The combinatorial logic output signal is applied to one input of NOR gate 37, as noted below, to flash the eye LED's 14 and 16, and is also applied to a further two-input NOR gate 82, the other input terminal of which is receptive of the output signals of exclusive OR gate 66. NOR gate 82 operates to interrupt the output signal of combinatorial logic 74 at pseudo-random intervals, to produce pulses of pseudo-random duration. Thus, the output signal of circuit 54 generated at the output terminal of NOR gate 82 comprises electrical pulses which are pseudo-random both as to frequency composition and duration, in simulation of syllabic speech.

In accordance with another aspect of the present invention, the application of the pulse trains to transducer 22 is controlled such that the pulse trains are random in duration, simulating intelligent speech. As noted above, flip-flop 36 is set in response to generation of an actuation signal in response to detection of complex sounds such as speech. Upon setting of flip-flop 36, eye LED's 14 and 16 are activated, in effect, acknowledging that the toy has been addressed, and after a predetermined delay period determined by flip-slops 40, 42 and 46, NOR gate 60 is enabled to apply the electrical tone pulses to transducer 22 and generating an audio output. Gate 50 remains enabled until the generation of an end-of-period signal, which operates to reset flip-flop 36 and flip-flop 46. The duration of the period during which gate 50 is enabled is suitably made random by periodically generating the end of period signal in accordance with a free running clock. For example, in the preferred exemplary embodiment, the end of pulse reset signal is generated by a length of speech circuit 84 comprising a counter formed of a chain of D-type flip-flops 86–88. Flip-flops 86–88 generate the end of period reset signal every eight pulses of a 1.5 Hz clock signal. The point in time at which the actuation signal is generated is random relative the cycle time of length of speech circuit 84, and thus the duration of the period during which gate 50 is enabled is also random.

As noted above, signal enabling gate 50 is also applied to an illumination circuit 52 associated with mouth portion 18 of body 12. Circuit 52 suitably comprises a bank of NOR gates 90, 92 and 94, the output terminals of which are applied through driving inverters 96, 98 and 100 to respective LED's 102, 104 and 106. LED's 102, 104 and 106 are disposed within mouth portion 18 of body 12. NOR gates 90, 92 and 94 are each receptive at one input terminal thereof of the Q output of flip-flop 46 (utilized to enable NOR gate 50). The other input terminals thereof are coupled to the eighth, sixth, and fourth stage output terminals of shift register 64. Accordingly, LED's 102, 104 and 106 are activated in a pseudo-random fashion during those periods wherein an audio output is generated by transducer 22. Thus, LED's 102, 104 and 106, in effect, simulate motion of the mouth portion 18 of body 12 during periods of speech.

Figure 2A:
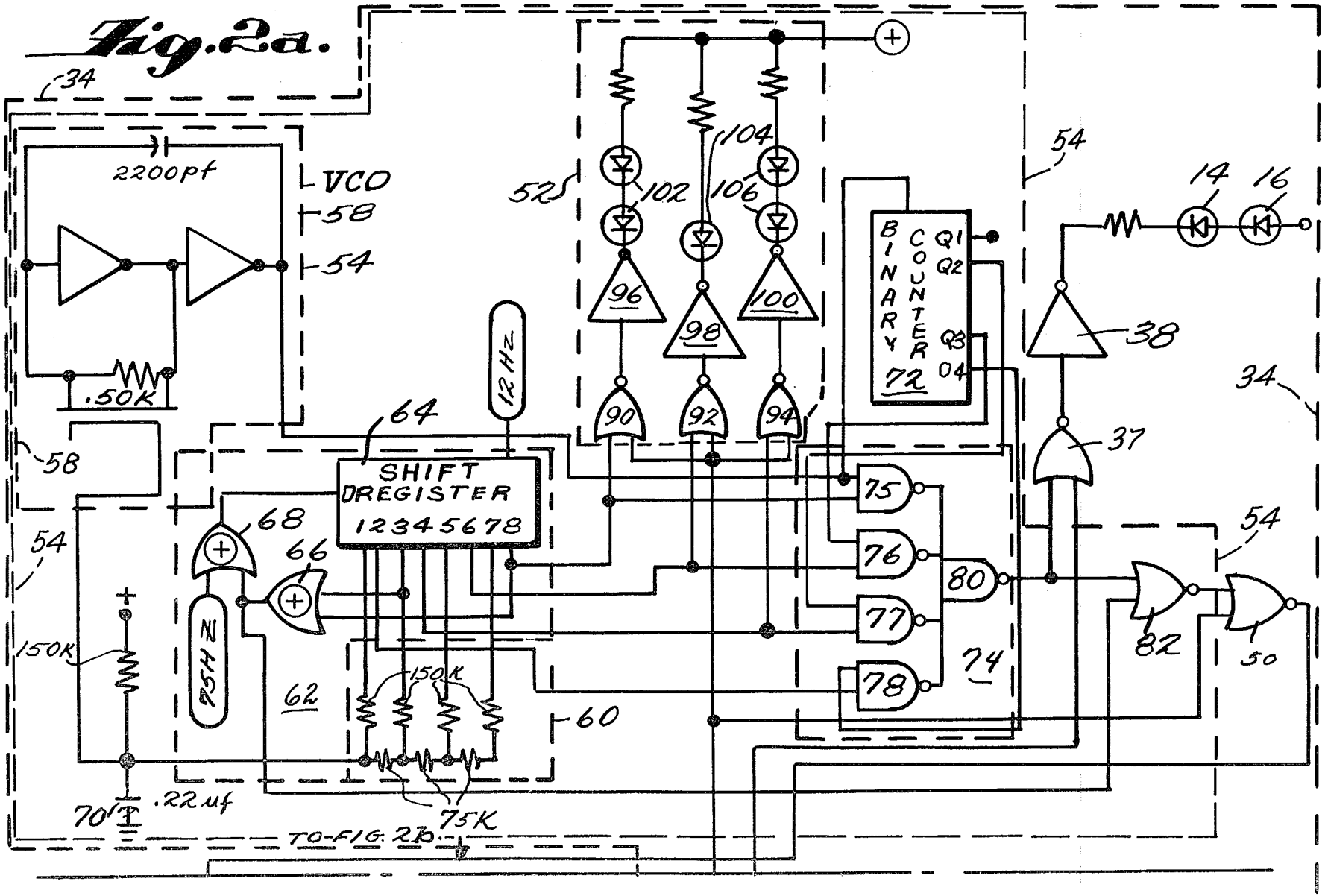
Figure 2B:
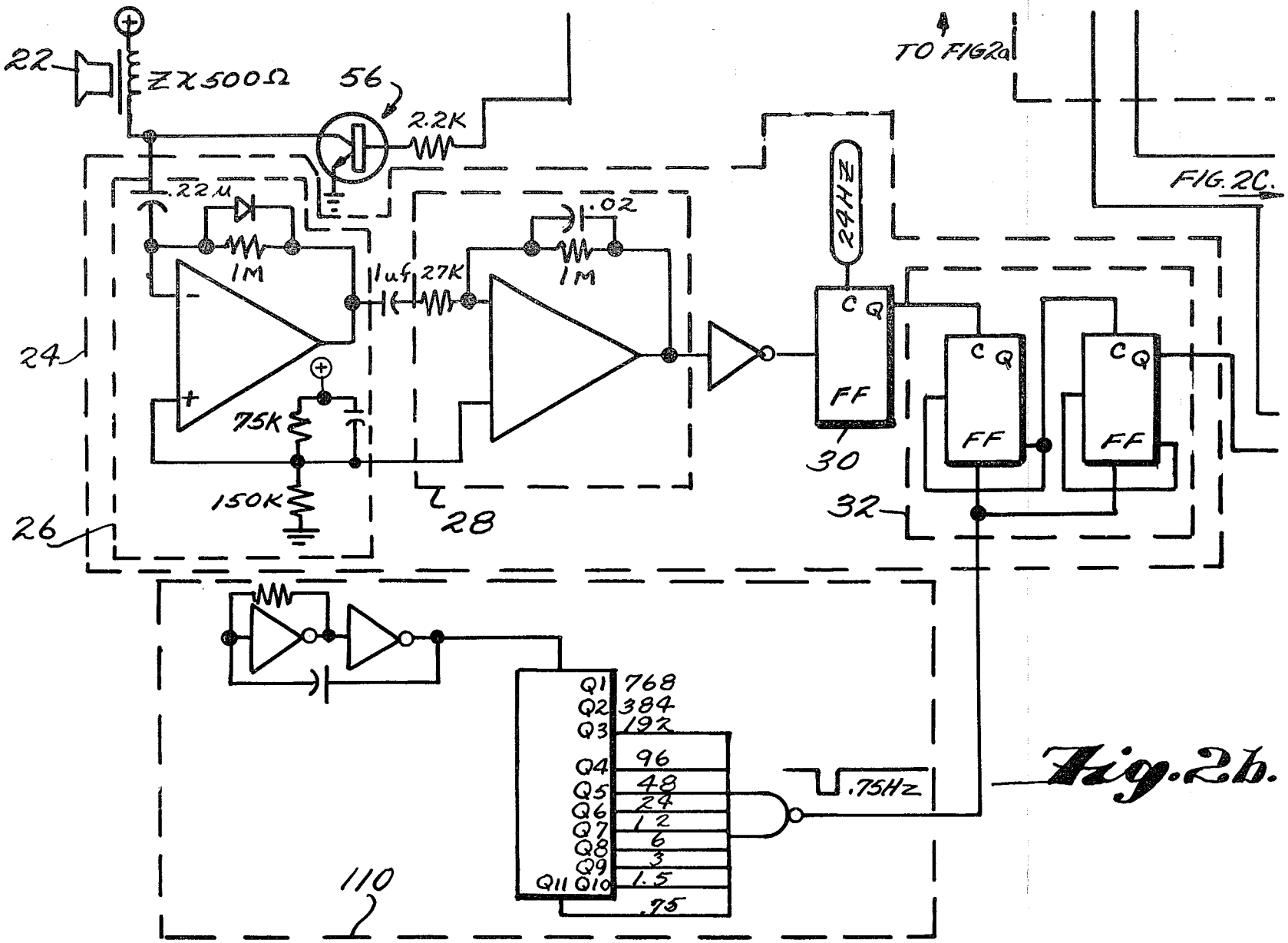
Figure 2C:
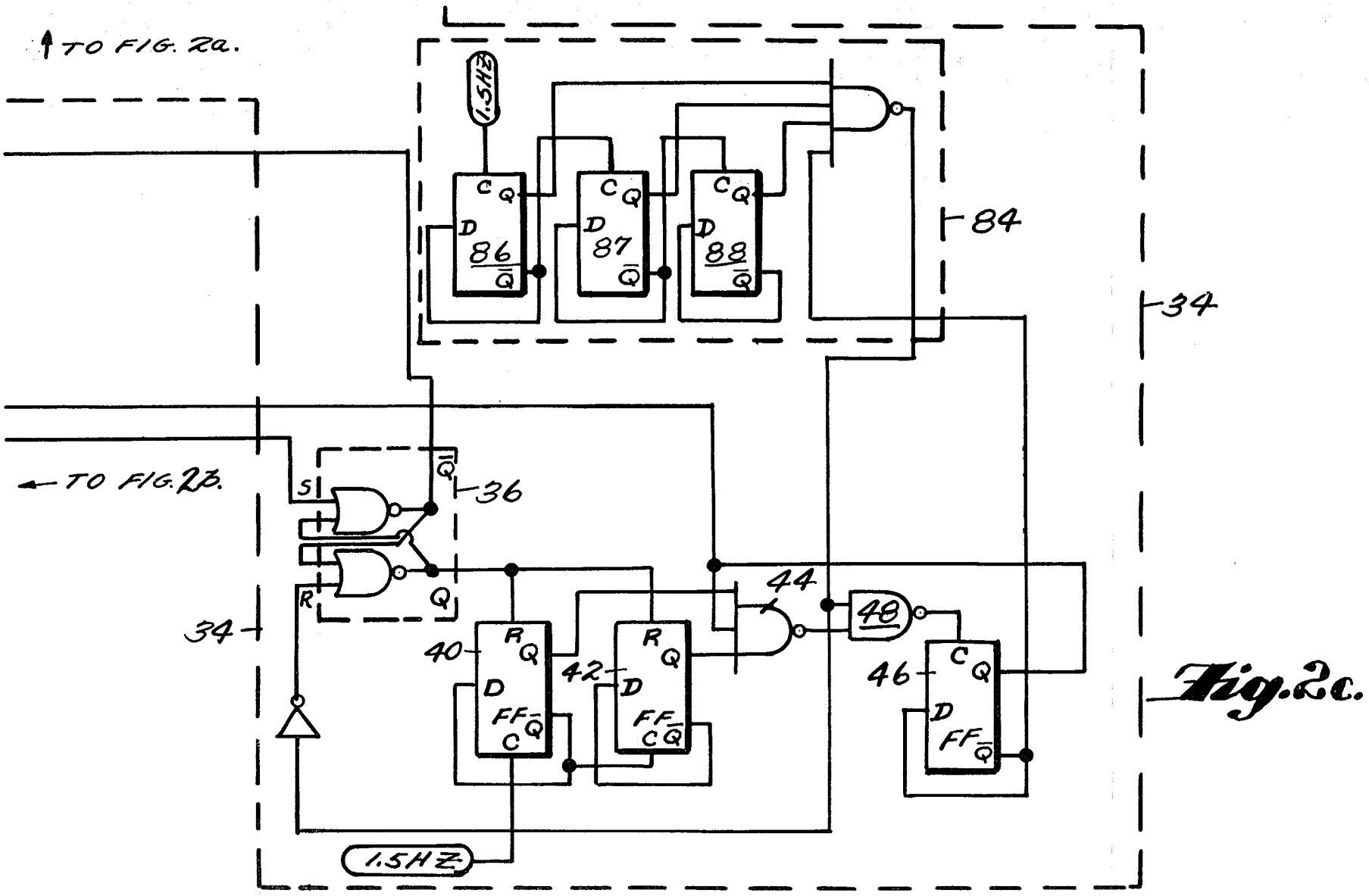

The various clock and reset signals of particular frequency referred to herein are suitably generated by an oscillator and master countdown chain (divider) generally indicated in FIG. 2*b* as 110.

It should be appreciated that while various connections between elements are shown in the drawing as single lines, they may in fact, comprise plural connections as is known in the art. Further, it will be understood that the above description is of illustrative embodiments of the present invention, and that the invention is not limited to the specific form shown. For example, if it is not desirable that the toy be responsive to complex sounds, other means for generating actuation signals may be provided. To this end, a simple switch can be utilized to effect generation of an audio output upon command. Similarly, the duration of the speech output pulse train can be made fixed, or pseudo-random rather than random, if desired. These and other modifications can be made in the design and arrangement of the elements as will be apparent to those skilled in the art, without departing from the scope of the invention as expressed in the appended claims.

What is claimed is:

1. A toy comprising:

a body;

actuator means, disposed within said body, for generating an actuation signal; and audio generator means, disposed in said body and responsive to said actuation signal, for generating electrical tone pulses, said electrical pulses being pseudo-random both as to frequency composition and duration; and transducer means responsive to said electrical tone pulses for generating audio output pulses indicative of said electrical pulses.

2. The toy of claim 1 wherein said actuator means comprises sound responsive means for generating said actuation signal in response to a predetermined species of sound.

3. The toy of claims 1 or 2 wherein said body includes a portion defining a mouth and said toy further includes:

illuminating means disposed in said mouth and responsive to said actuation signal, for illuminating said mouth in accordance with the generation of said audio output pulses.

4. The toy of claims 1 or 2 wherein said body includes portions representative of eyes, and further including:

illumination means disposed in said eye portions and responsive to control signals applied thereto for illuminating said eyes in accordance with generation of said actuation signal.

5. A toy comprising:

a body;

audio generator means, disposed in said body and responsive to an actuation signal applied thereto, for generating electrical tone pulses, said electrical pulses being pseudo-random as to frequency composition and duration;

transducer means, responsive to said electrical tone pulses for generating audio output pulses indicative of said electrical pulses, and including means for generating an electrical output signal indicative of audio sound waves incident thereon; and sound responsive actuator means, disposed within said body, for generating said actuation signal in response to a predetermined species of sound, said sound responsive means comprising:

sampling means, responsive to a sampling clock signal applied thereto, for sampling said transducer means electrical output signal at predetermined time intervals in accordance with said sampling clock signal and generating a digital sample signal indicative of said samples; and counter means, incremented responsive to changes of state in said digital sample signal and reset responsive a reset signal of predetermined frequency applied thereto, for generating said actuation signal upon accumulation of a predetermined number of counts such that said actuation signal is generated only in response to sound waves effecting said predetermined number of changes in state in said digital sample signal within a predetermined period in accordance with said reset signal frequency.

6. The toy of claim 5 wherein said sampling means comprises:

rectifier means for generating a rectified signal indicative of said transducer means electrical output signal;

means, responsive to said rectified signal, for integrating and clipping said rectified signal; and a D-type flip-flop receptive of said integrated and clipped signal and said sampling clock signal, for generating said digital signal, the valve of said digital signal being representative of instantaneous value of said integrated and clipped signal at sampling times in accordance with said clock signal.

7. The toy of claim 5 wherein said audio generator means comprises:

a voltage controlled oscillator (VCO) for generating a VCO output signal having a frequency in accordance with a control voltage applied thereto;

pseudo-random code generator means for generating a pseudo-random code signal;

D/A converter means, responsive to said pseudo-random code signal, for generating said control voltage to said VCO;

divider means, responsive to said VCO output signal, for generating a plurality of tone signals of respective frequencies related to said VCO output signal frequency;

first gate means, responsive to a signal indicative of said pseudo-random code signal for generating said electrical tone pulses, said electrical pulses being formed of pseudo-random combinations of said respective tone signals, pseudo-randomly interrupted to control the duration of said pulses; and audio response length control means, responsive to said electrical tone pulses and to said actuation signal, for selectively applying said electrical tone pulses as electrical input signals to said transducer means.

8. The toy of claim 5 wherein said body includes a portion defining a mouth and said toy further includes:

illuminating means disposed in said mouth and responsive to said actuation signal, for illuminating said mouth in accordance with the generation of said audio output pulses.

9. The toy of claim 5 wherein said body includes portions representative of eyes, and further including:

illumination means disposed in said eye portions and responsive to control signals applied thereto for illuminating said eyes in accordance with generation of said actuation signal.

10. A toy comprising:

a body;

actuator means, disposed within said body, for generating an actuation signal; and audio generator means, disposed in said body and responsive to said actuation signal, for generating electrical tone pulses, said electrical pulses being pseudo-random as to frequency composition and duration; and transducer means responsive to said electrical tone pulses for generating audio output pulses indicative of said electrical pulses, said audio generator means comprising:

a voltage controlled oscillator (VCO) for generating a VCO output signal having a frequency in accordance with a control voltage applied thereto;

pseudo-random code generator means for generating a pseudo-random code signal;

D/A converter means, responsive to said pseudo-random code signal, for generating said control voltage to said VCO;

divider means, responsive to said VCO output signal, for generating a plurality of tone signals of respective frequencies related to said VCO output signal frequency;

first gating means, responsive to a signal indicative of said pseudo-random code signal for generating said electrical tone pulses, said electrical pulses being formed of pseudo-random combinations of said respective tone signals, pseudo-randomly interrupted to control the duration of said pulses; and audio response length control means, responsive to said electrical tone pulses and to said actuation signal, for selectively applying said electrical tone pulses as electrical input signals to said transducer means.

11. The toy of claim 10 wherein said actuator means comprises sound responsive means for generating said actuation signal in response to a predetermined species of sound.

12. The toy of claim 7, 10 or 11 wherein said audio response length control means comprises:

second gating means, responsive to said actuation signal for applying said electrical tone pulses to said transducer means during periods of random duration subsequent to generation of said actuation signal.

13. The toy of claim 12 wherein said second gating means comprises:

a gate device responsive to gate control signals applied thereto;

means, responsive to said actuation signal and a period end signal applied thereto, for generating a gate control signal to enable said gate device after a predetermined period subsequent to generation of said actuation signal, and for generating a gate control signal to inhibit said gate device in response to said period and signal; and free running counter means for periodically generating said period end signal, whereby the period during which said audio pulses are generated is randomly controlled in accordance with the time relationship of generation of said actuation signal and generation of said period end signal.

14. The toy of claim 7, 10 or 11 wherein said pseudo-random code generator comprises:

a shift register, having a data input terminal and an output terminal corresponding to each stage thereof, and responsive to shift register clock signals applied thereto, said shift register output terminals being coupled to said D/A converter means; and a two-input exclusive OR gate, having input terminals connected to respective ones of said shift register output terminals and to an output terminal supplying signals to said shift register data terminal.

15. The toy of claim 14 wherein said first gating means comprises:

combinatorial logic means responsive to said pseudo-random code signal, and at least said tone signals, for generating an output signal formed of psuedo-random combinations of said tone signals; and a two-input gate device, responsive to the output signals of said combinatorial logic means and the output of said exclusive OR gate for pseudo-randomly interrupting said combinatorial logic means output signal.

16. The toy of claim 15 wherein said combinatorial logic comprises:

a plurality of two-input NAND gates, each responsive to a respective one of said tone signals, and to signals from a respective one of said shift register output terminals;

a multi-input gate responsive to the output signals of said two-input NAND gates; and wherein said two-input gate device comprises a two-input NOR gate responsive to said exclusive OR gate output signals and said multi-input NAND gate output signals.

17. The toy of claim 14 wherein said body includes a portion representing a mouth and said toy further comprises:

a plurality of light emitting devices disposed in said mouth portion and responsive to control signals applied thereto; and second gating means, responsive to signals indicative of said pseudo-random code signal and a signal indicative of the generation of said audio output pulses, for selectively generating control signals to activate said light emitting devices.

18. The toy of claim 14 wherein said pseudo-random code generator further comprises a second two input exclusive OR gate having one input thereof connected to the output terminal of said first mentioned exclusive OR gate and the second input thereof receptive of a clock signal of predetermined frequency.

19. The toy of claim 15 wherein said body includes portions representing eyes and further comprising:

light emitting devices disposed in said eye portions; and second gating means, responsive to signals indicative of generation of said actuation signal and said combinatorial logic means output signal for selectively energizing said light emitting devices.

* * * * *